US007312685B1

(12) United States Patent
Lee

(10) Patent No.: US 7,312,685 B1
(45) Date of Patent: Dec. 25, 2007

(54) SYMMETRICAL INDUCTOR

(75) Inventor: Sheng-Yuan Lee, Taipei (TW)

(73) Assignee: VIA Technologies, Inc., Taipei (TW)

( * ) Notice: Subject to any disclaimer, the term of this patent is extended or adjusted under 35 U.S.C. 154(b) by 0 days.

(21) Appl. No.: 11/673,613

(22) Filed: Feb. 12, 2007

(30) Foreign Application Priority Data

Sep. 11, 2006 (TW) ..... 95133444 A

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 6,002,161 A * 12/1999 Yamazaki ..... 257/531
6,380,835 B1 * 4/2002 Lee ..... 336/200
7,057,488 B2 * 6/2006 Van Haaren et al. ..... 336/200
7,068,140 B2 * 6/2006 Chou ..... 336/200
7,259,649 B2 * 8/2007 Ancey et al. ..... 336/200

* cited by examiner

*Primary Examiner*—Anh Mai
(74) *Attorney, Agent, or Firm*—Thomas, Kayden, Horstemeyer & Risley

(57) ABSTRACT

An inductor comprises first and second winding portions symmetrically arranged in an insulating layer on a substrate. Each winding portion comprises first, second and third semicircular conductive traces arranged in concentricity from the inside to the outside. Each semicircular conductive trace has first and second ends, in which the first ends of the first semicircular conductive traces of the first and second winding portions are coupled to each other. A coupling portion comprises a first pair of connection layers cross-connecting the first ends of the second and third semicircular conductive traces of both winding portions and a second pair of connection layers cross-connecting the second ends of the first and second semicircular conductive traces of both winding portions. The adjacent semicircular conductive traces of each winding portion have a trace line space therebetween and the relatively outer trace line space is wider than the relatively inner trace line space.

20 Claims, 5 Drawing Sheets

SYMMETRICAL INDUCTOR

BACKGROUND OF THE INVENTION

1. Field of the Invention

The invention relates to semiconductor devices and in particular to a symmetrical inductor in differential operation.

2. Description of the Related Art

Many digital and analog elements and circuits have been successfully applied to semiconductor integrated circuits. Such elements may include passive components, such as resistors, capacitors, or inductors. Typically, a semiconductor integrated circuit includes a silicon substrate. One or more dielectric layers are disposed on the substrate, and one or more metal layers are disposed in the dielectric layers. The metal layers may be employed to form on-chip elements, such as on-chip inductors, by current semiconductor technologies.

Conventionally, the on-chip inductor is formed over a semiconductor substrate and employed in integrated circuits designed for radio frequency (RF) band. FIG. 1 is a plane view of a conventional on-chip inductor with a planar spiral configuration. The on-chip inductor is formed in an insulating layer 104 on a substrate 100, comprising a spiral conductive trace 103 and an interconnect structure. The spiral conductive trace 103 is embedded in the insulating layer 104. The interconnect structure includes conductive plugs 105 and 109, a conductive trace 107 embedded in an underlying insulating layer (not shown), and a conductive trace 111 embedded in the insulating layer 104. An internal circuit of the chip or an external circuit may provides a current passing through the coil, which includes the spiral conductive trace 103, the conductive plugs 105 and 109, and the conductive traces 107 and 111, and utilize the inductance induced by the coil.

A principle advantage of the planar spiral inductor is increased circuit integration due to fewer circuit elements located off the chip along with attendant need for complex interconnections. Moreover, the planar spiral inductor can reduce parasitic capacitance induced by the bond pads or bond wires between on-chip and off-chip circuits.

The planar spiral inductor, however, occupies a larger area of the chip and has lower quality factor (i.e. Q value). To reduce chip area and improve Q value, thickness of the spiral conductive trace 103 is increased, and trace line space S between the inner and outer coils is reduced.

However, wireless communication chip designs more frequently employ differential circuits to reduce common mode noise, with inductors applied therein symmetrically. The symmetrical application results in the inductor having the same structure from any end. The planar spiral inductor shown in FIG. 1 is not symmetrical, and, if applied in a differential circuit, will not suitably prevent common mode noise.

BRIEF SUMMARY OF INVENTION

A detailed description is given in the following embodiments with reference to the accompanying drawings.

An inductor is provided. An embodiment of an inductor comprises first and second winding portions symmetrically arranged in an insulating layer on a substrate. Each winding portion comprises first, second and third semicircular conductive traces arranged in concentricity from the inside to the outside. Each semicircular conductive trace has first and second ends. And the first ends of the first semicircular conductive traces of the first and second winding portions are coupled to each other. A coupling portion comprises a first pair of connection layers, that cross connects the first ends of the second and third semicircular conductive traces of both winding portions, and a second pair of connection layers, that cross connects the second ends of the first and second semicircular conductive traces of both winding portions. The adjacent semicircular conductive traces of each winding portion have a trace line space therebetween and the outer trace line space is wider than the inner trace line space.

A symmetrical inductor is provided. An embodiment of an inductor comprises a plurality of semicircular conductive traces disposed in an insulating layer and arranged in concentricity. Each semicircular conductive trace has a first end and a second end, wherein the first ends of the two inmost semicircular conductive traces are coupled to each other. At least one first pair of connection layers is connected to the first ends of the semicircular conductive traces and at least one second pair of connection layers is connected to the second ends of the semicircular conductive traces. The adjacent semicircular conductive traces have a trace line space therebetween and the relatively outer trace line space is wider than the relatively inner trace line space.

A symmetrical inductor is provided. An embodiment of an inductor comprises a first winding portion and a second winding portion all disposed in an insulating layer, comprising a plurality of conductive traces, respectively. The second winding portion is symmetrically arranged with the first winding portion. At least two semicircular conductive traces are disposed in the insulating layer and outside the first or second winding portion. The semicircular conductive traces are electrically connected to the first and second winding portions, respectively. The semicircular conductive trace and the adjacent first or second winding portion have a trace line space therebetween, wider than a line space between the adjacent conductive traces in each winding portion.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated modes of carrying out the invention. This description is provided for the purpose of illustrating the general principles of the invention and should not be taken in a limiting sense. The scope of the invention is best determined by reference to the appended claims. The symmetrical inductor of the invention will be described in the following with reference to the accompanying drawings.

Figure 1:
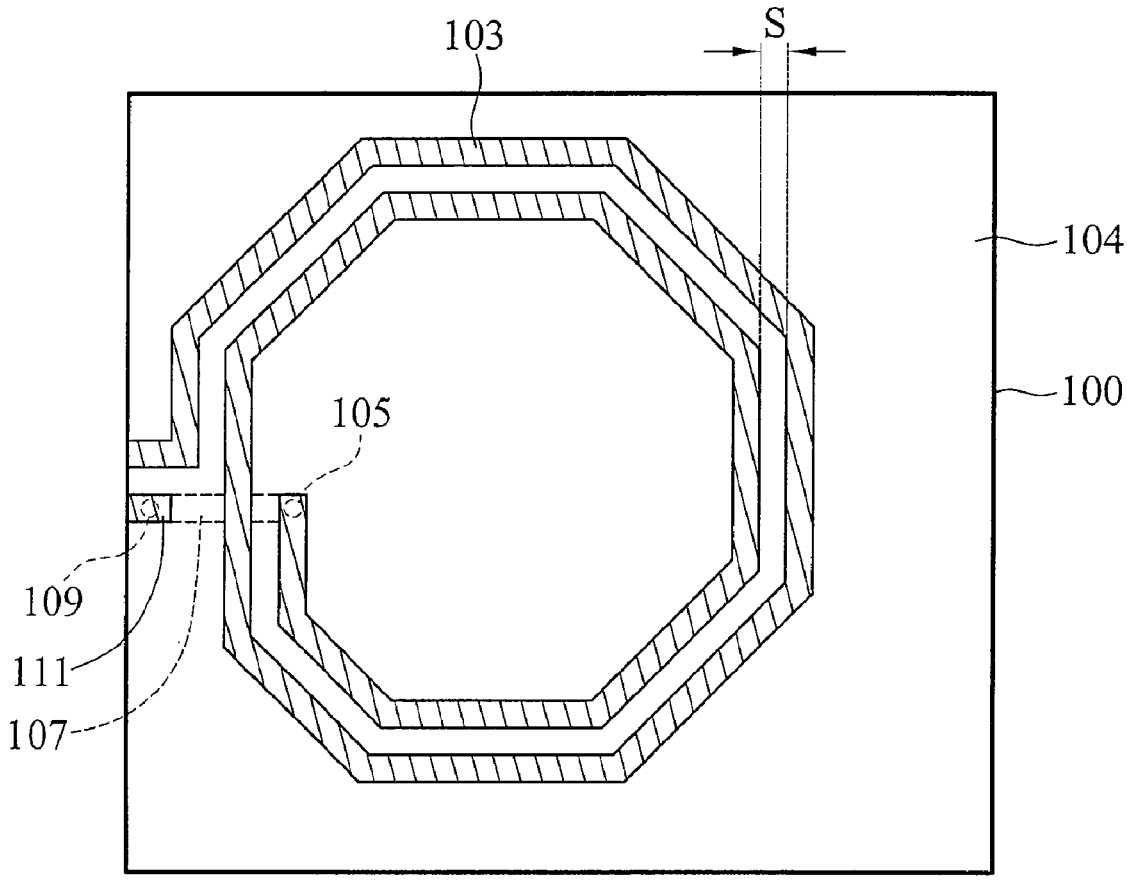
FIG. 1 ( RELATED ART )
FIG. 1 is a plane view of a conventional on-chip inductor with a planar spiral configuration.
Figure 2:
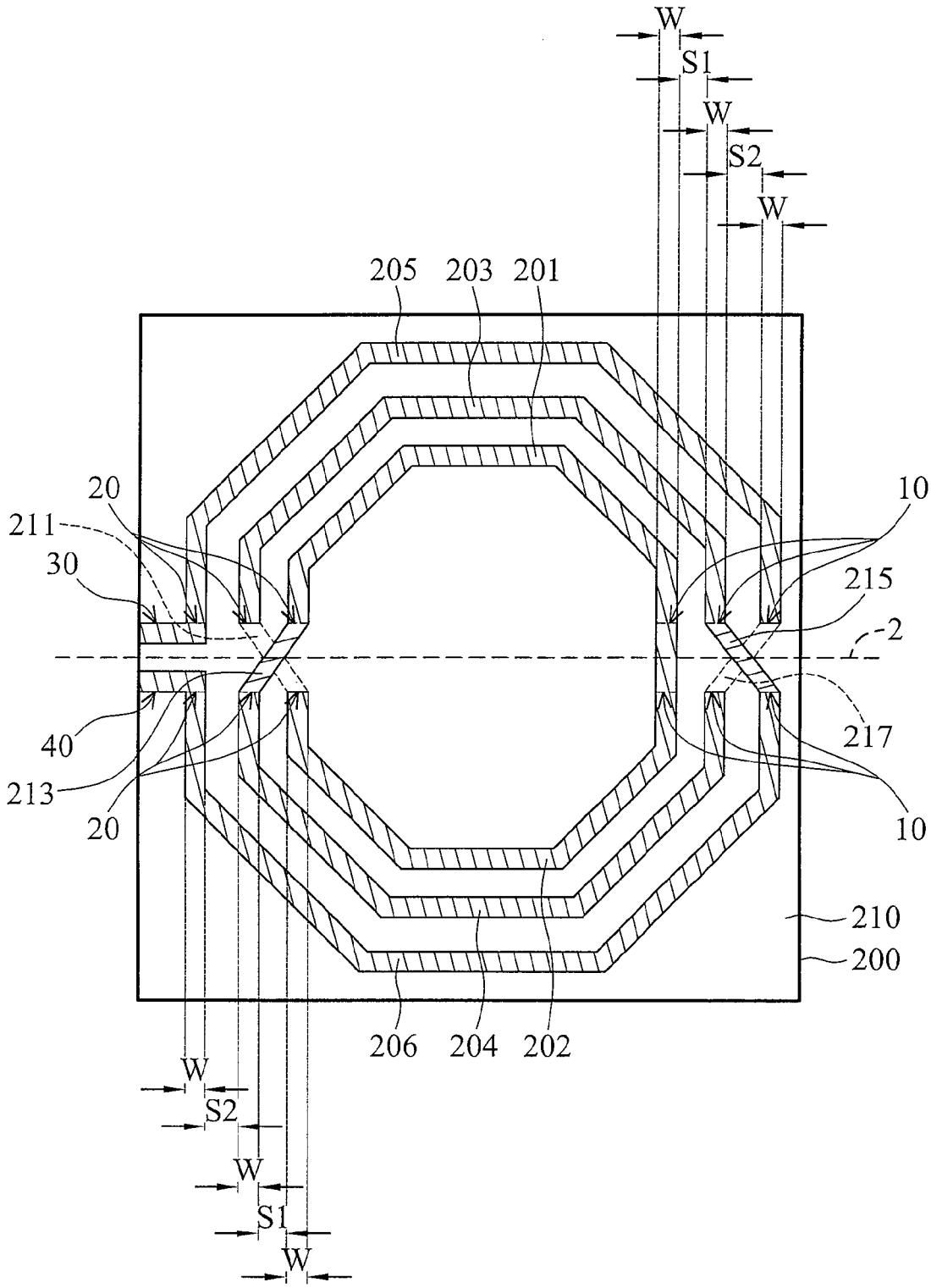
FIG. 2 is a plane view of an embodiment of a three-turn symmetrical inductor.

FIG. 2 is a plane view of a three-turn symmetrical inductor of an embodiment of the invention. The symmetrical inductor comprises an insulating layer 210 disposed on a substrate 200. The substrate 200 may be a silicon substrate or other known semiconductor substrates. The substrate 200 may include various elements, such as transistors, resistors, or other well-known semiconductor elements. Moreover, the substrate 200 may also include other conductive layers (e.g. copper, aluminum, or alloy thereof) and insulating layers (e.g. silicon oxide, silicon nitride, or low-k dielectric material). Hereinafter, to simplify the diagram, only a flat substrate is depicted. Additionally, the insulating layer 210 may be a single low-k dielectric layer or multi-layer dielectrics. In this embodiment, the insulating layer 210 may include silicon oxide, silicon nitride, or low-k dielectric material.

The first winding portion is disposed in the insulating layer 210 and located at a first side of dashed line 2. The first winding portion may comprise a first semicircular conductive trace 201, a second semicircular conductive trace 203 and a third semicircular conductive trace 205 arranged in concentricity from inside to outside. The second winding portion is disposed in the insulating layer 210 and located at a second side opposite to the first side of dashed line 2. The second winding portion may comprise a first semicircular conductive trace 202, a second semicircular conductive trace 204 and a third semicircular conductive trace 206 arranged in concentricity from inside to outside. The second winding portion and the first winding portion aresymmetrical symmetrical with respect to the dashed line 2.

The first and second winding portions may be circular, rectangular, hexagonal, octagonal, or polygonal. Hereinafter, to simplify the diagram, only an exemplary octagonal shape is depicted. Moreover, the first and second winding portions may comprise copper, aluminum, or alloy thereof. In this embodiment, the first, second, and third semicircular conductive traces 201, 203 and 205 of the first winding portion and the first, second, and third semicircular conductive traces 202, 204 and 206 of the second winding portion have the same trace line width W.

Each semicircular conductive trace has a first end 10 and a second end 20. In this embodiment, the first end 10 of the first semicircular conductive trace 201 of the first winding portion and the first end 10 of the first semicircular conductive trace 202 of the second winding portion are coupled. The third semicircular conductive traces 205 and 206 of the first and second winding portions have lateral extending portions 30 and 40 as an input or an output for inputting differential signals.

In the embodiment, to maintain geometric symmetry, a coupling portion is disposed in the insulating layer 210 between the first and second winding portions, and the coupling portion comprises a first pair of connection layers and a second pair of connection layers. The first pair of connection layers cross-connects the first ends 10 of the second semicircular conductive trace 203 and the third semicircular conductive trace 206 and also cross-connects the first ends 10 of the second semicircular conductive trace 204 and the third semicircular conductive trace 205. Moreover, the second pair of connection layers cross-connects the second ends 20 of the first semicircular conductive trace 201 and the second semicircular conductive trace 204 and also cross-connects the second ends 20 of the first semicircular conductive trace 202 and the second semicircular conductive trace 203. For example, the first pair of connection layers may comprise an upper cross-connection 215 to couple the first ends 10 of the second semicircular conductive trace 203, and the third semicircular conductive trace 206 and the pair may comprise a lower cross-connection 217 to couple the first ends 10 of the second semicircular conductive trace 204 and the third semicircular conductive trace 205. The second pair of connection layers may comprise an upper cross-connection 213 to couple the second ends 20 of the first semicircular conductive trace 201 and the second semicircular conductive trace 204, and the pair may comprise a lower cross-connection 211 to couple the second ends 20 of the first semicircular conductive trace 202 and the second semicircular conductive trace 203.

Generally, since in the single-ended operation the signals with the same phase may pass through the adjacent conductive traces of the inductor, the parasitic capacitance between the adjacent conductive traces is lower and may be ignored. Accordingly, the trace line space between the winding portions may be designed to be as small as possible to enhance inductor performance. However, unlike the inductor in single-ended operation, the signals with phase difference of 180° may pass through the adjacent conductive traces of the inductor in differential operation. Thus, the parasitic capacitance between the adjacent conductive traces may be increased due to the signals with difference phase and cannot be ignored. In particular, the parasitic capacitance between the outmost conductive traces of the inductor is of concern. When the parasitic capacitance is increased, peak Q-factor frequency may be reduced and the inductance value deviation increased, so that the usable frequency range of the inductor is reduced.

Accordingly, in the invention, the adjacent semicircular conductive traces of each winding portion have a trace line space there between. And at least one relatively outer trace line space is wider than at least one relatively inner trace line space. For example, the trace line space S2 between the second semicircular conductive trace 203 and the third semicircular conductive trace 205 and the trace line space S2 between the second semicircular conductive trace 204 and the third semicircular conductive trace 206 can be wider than the trace line space Si between the second semicircular conductive trace 203 and the first semicircular conductive trace 201 and the trace line space SI between the second semicircular conductive trace 204 and the first semicircular conductive trace 202 (i.e. S2>S1). Since the outmost trace line space S2 is increased, the parasitic capacitance can be reduced when the symmetrical inductor is in the differential operation, thereby increasing the usable frequency range of the inductor.

Figure 3:
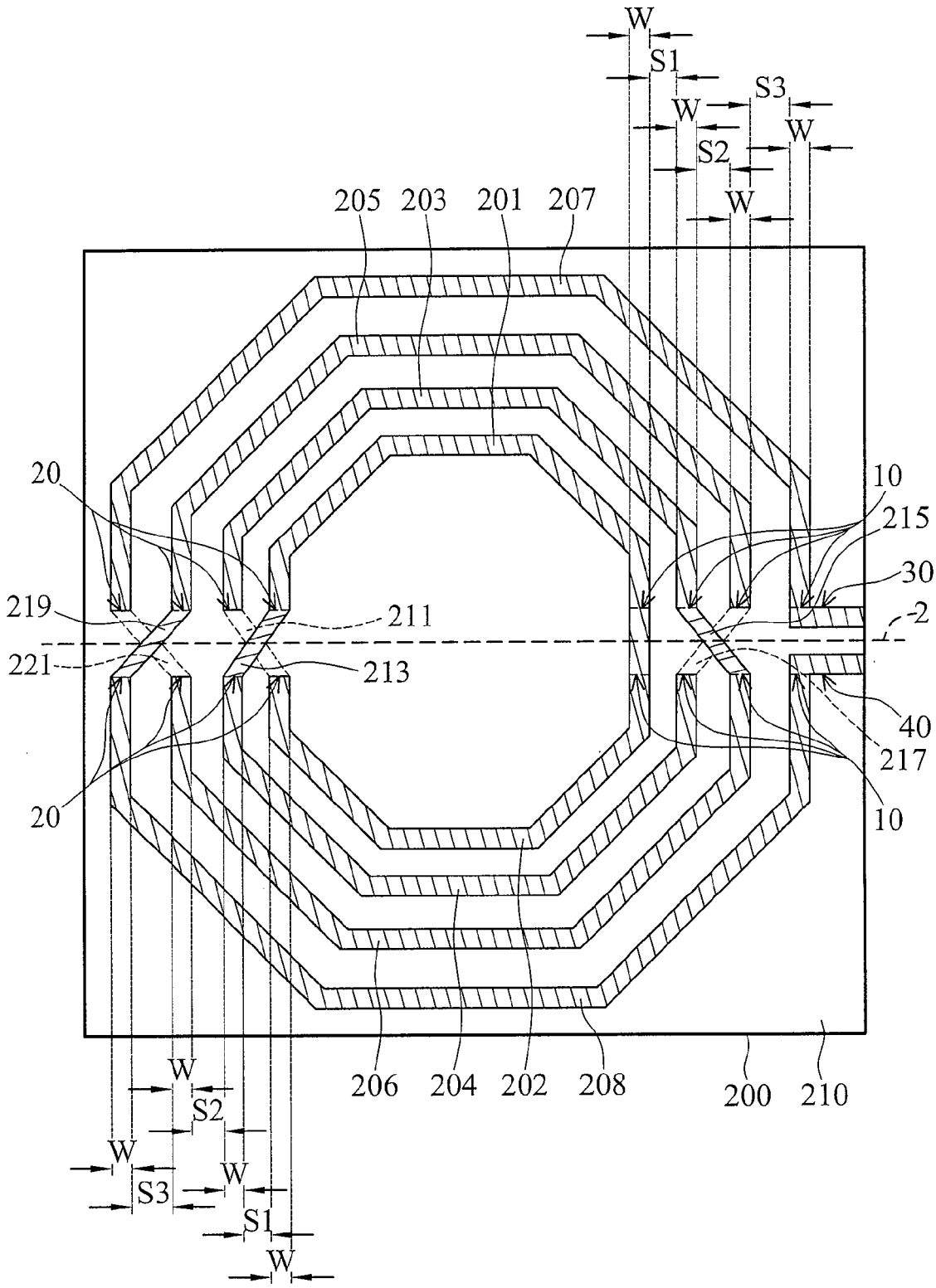
FIG. 3 is a plane view of an embodiment of a four-turn symmetrical inductor.

FIG. 3 illustrates a four-turn symmetrical inductor of another embodiment of the invention. Elements in FIG. 3 the same as in FIG. 2 are labeled the same and are not described again. In FIG. 3, the first and second winding portions further comprise fourth semicircular conductive traces 207 and 208 located at outside of the third semicircular conductive traces 205 and 206, respectively. Also, the fourth semicircular conductive traces 207 and 208 have the same trace line width W. Moreover, the coupling portion further comprises a third pair of connecting layers. The third pair cross-connects the second ends 20 of the third semicircular conductive trace 205 and the fourth semicircular conductive trace 208 and also cross-connects the second ends 20 of the third semicircular conductive trace 206 and the third semicircular conductive trace 207. For example, the third pair of connection layers may comprise an upper cross-connection 219 to couple the second ends 20 of the third semicircular conductive trace 205 and the fourth semicircular conductive trace 208, and the third pair may also comprise a lower cross-connection 221 to couple the second ends 20 of the third semicircular conductive trace 206 and the fourth semicircular conductive trace 207. Moreover, the first ends 10 of the fourth semicircular conductive traces 207 and 208 of the first and second winding portions have lateral extending portions 30 and 40 as an input or an output for inputting differential signals.

In this embodiment, the trace line spaces are gradually increased from inside to outside. For example, the trace line space S3 between the third semicircular conductive traces 205 and 206 and the trace line space S3 between the fourth semicircular conductive traces 207 and 208 are wider than the trace line space S2 between the second semicircular conductive traces 203 and 204 and the trace line space S2 between the third semicircular conductive traces 205 and 206. Moreover, the trace line space S2 between the second semicircular conductive traces 203 and 204 and the trace line space S2 between the third semicircular conductive traces 205 and 206 are wider than the trace line space SI between the second semicircular conductive traces 203 and 204 and the trace line space Si between the first semicircular conductive traces 201 and 202 (i.e. S3>S2>S1).

Figure 4:
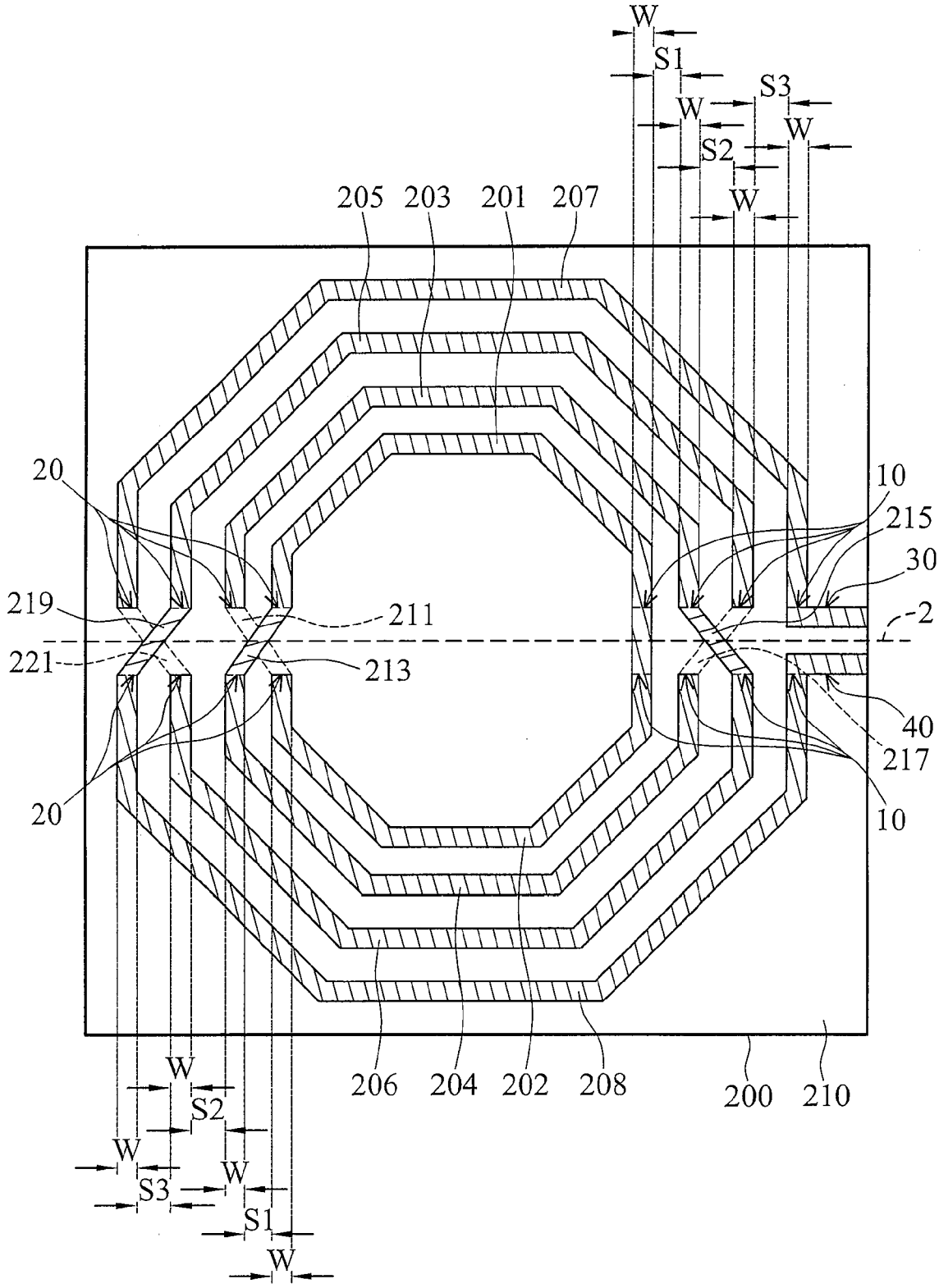
FIG. 4 is a plane view of an embodiment of a four-turn symmetrical inductor.
Figure 5:
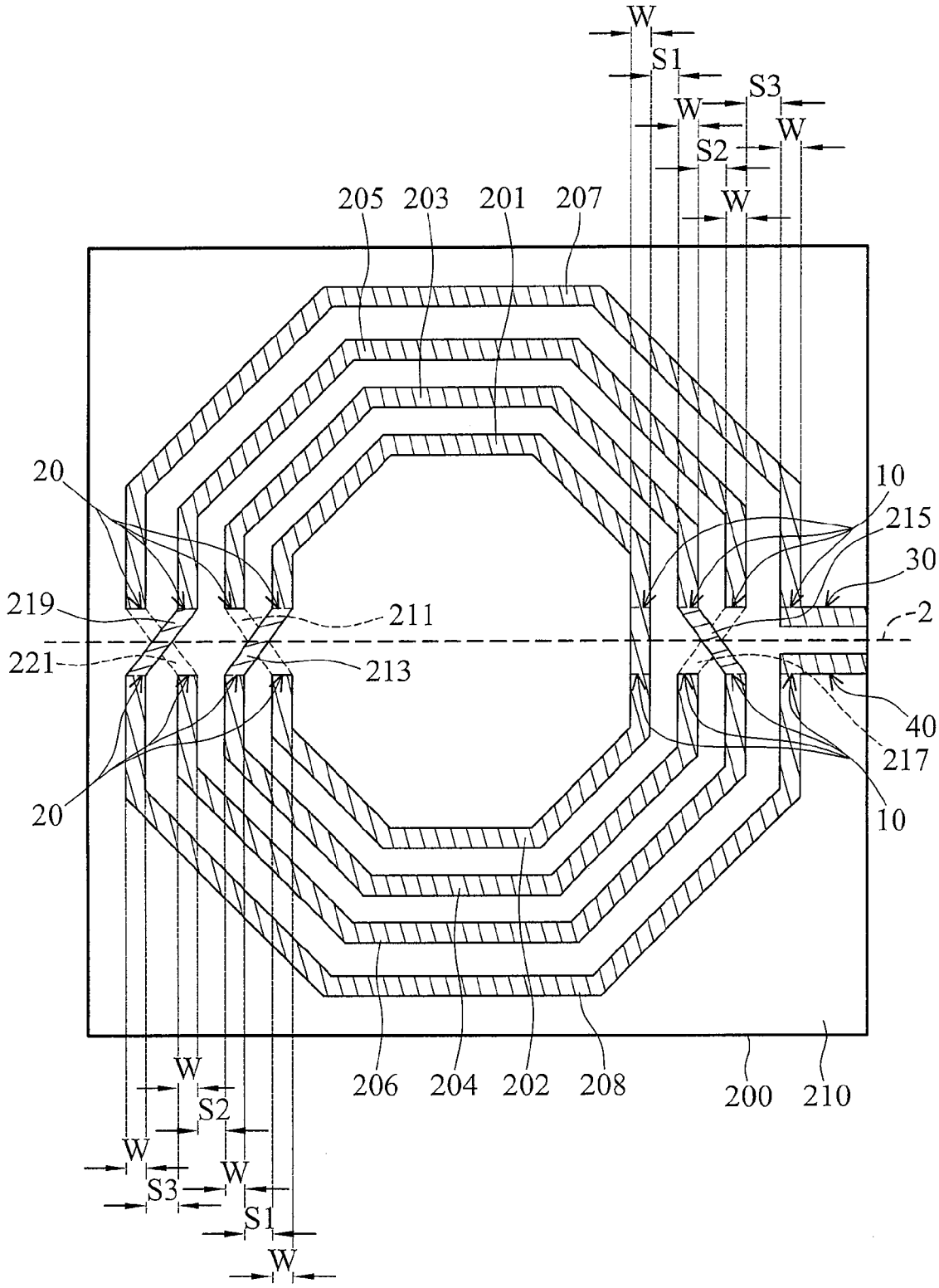
FIG. 5 is a plane view of an embodiment of a four-turn symmetrical inductor.

In some embodiments, the trace line space S3 may be substantially equal to the trace line space S2 and wider than the trace line space S 1 (i.e. S3=S2>S1), as shown in FIG. 4. In some embodiments, the trace line space S2 may be substantially equal to the trace line space S1 and narrower than the trace line space S3 (i.e. S3>S2=S1), as shown in FIG. 5. Since the outmost adjacent conductive traces have the widest trace line space, the parasitic capacitance may be reduced when the symmetrical inductor is in differential operation, thereby increasing the usable frequency range of the inductor. Additionally, it is to be noted that the invention is not limited to a four-turn symmetrical inductor. More than four-turn traces may also be applied to provide the advantages as set forth.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inductor, comprising:

an insulating layer disposed on a substrate;

first and second winding portions symmetrically arranged in the insulating layer, each winding portion comprising first, second and third semicircular conductive traces arranged from the inside to the outside, each semicircular conductive trace having a first end and a second end, wherein the first ends of the first semicircular conductive traces of the first and second winding portions are coupled to each other; and a coupling portion disposed in the insulating layer between the first and second winding portions, comprising:

a first pair of connection layers, connecting the first ends of the second and third semicircular conductive traces of the first and second winding portions; and a second pair of connection layers, connecting the second ends of the first and second semicircular conductive traces of the first and second winding portions;

wherein the adjacent semicircular conductive traces of each winding portion have a trace line space and the outer trace line space is wider than the inner trace line space.

2. The inductor as claimed in claim 1, wherein each winding portion further comprises a fourth semicircular conductive trace located outside of the third semicircular conductive trace, and the coupling portion further comprises a third pair of connection layers connecting the second ends of the third and fourth semicircular conductive traces of the first and second winding portions.

3. The inductor as claimed in claim 2, wherein the trace line space between the fourth and third semicircular conductive traces is substantially equal to that between third and second semicircular conductive traces and is wider than that between the second and first semicircular conductive traces.

4. The inductor as claimed in claim 2, wherein the trace line space between the second and first semicircular conductive traces is substantially equal to that between third and second semicircular conductive traces and is narrower than that between the fourth and third semicircular conductive traces.

5. The inductor as claimed in claim 2, wherein one of the third pair of connection layers is an upper cross-connection and the other is a lower cross-connection.

6. The inductor as claimed in claim 1, wherein the trace line width of each semicircular conductive trace is substantially the same.

7. The inductor as claimed in claim 1, wherein the first and second winding portions are circular, rectangular, hexagonal, octagonal, or polygonal.

8. The inductor as claimed in claim 1, wherein one of the first pair of connection layers is an upper cross-connection and the other is a lower cross-connection.

9. The inductor as claimed in claim 1, wherein one of the third pair of connection layers is an upper cross-connection and the other is a lower cross-connection.

10. An inductor, comprising:

an insulating layer;

a plurality of semicircular conductive traces disposed in the insulating layer and arranged in concentricity, each semicircular conductive trace having a first end and a second end, wherein the first ends of the two inmost semicircular conductive traces are coupled to each other;

at least one first pair of connection layers, connected to the first ends of the semicircular conductive traces; and at least one second pair of connection layers, connected to the second ends of the semicircular conductive traces;

wherein the adjacent semicircular conductive traces have a trace line space and the outer trace line space is wider than the inner trace line space.

11. The inductor as claimed in claim 10, wherein the trace line widths of the semicircular conductive traces are substantially the same.

12. The inductor as claimed in claim 10, wherein the semicircular conductive traces are circular, rectangular, hexagonal, octagonal, or polygonal.

13. The inductor as claimed in claim 1, wherein one of the first or second pair of connection layers is an upper cross-connection and the other is a lower cross-connection.

14. An inductor, comprising:

an insulating layer;

a first winding portion disposed in the insulating layer and comprising a plurality of semicircular conductive traces;

a second winding portion disposed in the insulating layer and comprising a plurality of semicircular conductive traces, wherein the second winding portion is symmetrical to the first winding portion;

two additional semicircular conductive traces located in a region outside the area surrounded by he first and second winding portions and disposed in the insulating layer, wherein the additional semicircular conductive traces are electrically connected to the first and second winding portions;

wherein the trace line space between one additional semicircular conductive trace and its corresponding winding portion is wider than the line space between two adjacent semicircular conductive traces of the first or second winding portion.

15. The inductor as claimed in claim 14, wherein each winding portion comprises first, second and third semicircular conductive traces arranged from the inside to the outside, wherein each semicircular conductive trace has a first end and a second end, wherein the first ends of the first semicircular conductive traces of the first and second winding portions are coupled to each other.

16. The inductor as claimed in claim 15, further comprising a coupling portion disposed in the insulating layer between the first and second winding portions, wherein the coupling portion comprises:

a first pair of connection layers connecting the first ends of the second and third semicircular conductive traces of the first and second winding portions; and a second pair of connection layers connecting the second ends of the first and second semicircular conductive traces of the first and second winding portions.

17. The inductor as claimed in claim 16, wherein one of the first or second pair of connection layers is an upper cross-connection and the other is a lower cross-connection.

18. The inductor as claimed in claim 15, wherein each winding portion further comprises a fourth semicircular conductive trace located outside of the third semicircular conductive trace, and the coupling portion further comprises a third pair of connection layers connecting the second ends of the third and fourth semicircular conductive traces of the first and second winding portions.

19. The inductor as claimed in claim 15, wherein the trace line widths of the semicircular conductive traces are substantially the same.

20. The inductor as claimed in claim 14, wherein the first and second winding portions are circular, rectangular, hexagonal, octagonal, or polygonal.

* * * * *